US005649393A

United States Patent [19]

Barry et al.

[11] Patent Number: 5,649,393

[45] Date of Patent: Jul. 22, 1997

[54] DOMED CEILING STRUCTURE

[76] Inventors: Michael A. Barry, 615 S. State College Blvd., Fullerton, Calif. 92631; George E. Goodwin, 1551 S. Highland, Apt. P, Fullerton, Calif. 92632

[21] Appl. No.: 570,907

[22] Filed: Dec. 12, 1995

[51] Int. Cl.[6] ..... E04B 1/32

[52] U.S. Cl. ..... 52/80.1; 52/82

[58] Field of Search ..... 52/80.1, 82, 745.07, 52/81.1, 81.2, 81.4, 28, 6; 362/148, 152, 153.1, 367

[56] References Cited

U.S. PATENT DOCUMENTS

| | | | |
|---|---|---|---|
| 323,110 | 7/1885 | Carlewitz . | |
| 468,354 | 2/1892 | Mayhew . | |
| 604,277 | 5/1898 | Tofft | 52/81.2 |
| 1,096,944 | 5/1914 | Phillips . | |
| 1,223,266 | 4/1917 | Dyer . | |
| 1,267,084 | 5/1918 | Knox . | |
| 1,762,363 | 6/1930 | Sergent . | |
| 1,938,024 | 12/1933 | Keeffe | 108/23 |
| 2,011,796 | 8/1935 | Christensen | 72/116 |
| 2,292,078 | 8/1942 | Inman et al. | 189/1.5 |
| 2,335,708 | 11/1943 | Strobel | 20/2 |
| 2,342,916 | 2/1944 | Blaski | 20/0.5 |
| 2,736,397 | 2/1956 | Colby, Jr. | 189/1 |
| 2,988,810 | 6/1961 | Wilken | 29/449 |
| 3,009,211 | 11/1961 | Hansen et al. | 20/1.13 |
| 3,034,824 | 5/1962 | Schubach | 296/28 |
| 3,130,488 | 4/1964 | Lindstrom | 52/80.1 X |
| 3,168,815 | 2/1965 | Blenkle et al. | 61/45 |
| 3,364,634 | 1/1968 | Allaire | 52/86 |
| 3,440,790 | 4/1969 | Nerem | 52/631 |
| 3,508,370 | 4/1970 | Riblet | 52/483 |
| 3,546,826 | 12/1970 | Chapman | 52/80.1 X |
| 3,763,618 | 10/1973 | Bennett et al. | 52/741 |
| 3,924,367 | 12/1975 | Stewart | 52/81.4 |
| 4,094,110 | 6/1978 | Dickens et al. | 52/80 |
| 4,241,555 | 12/1980 | Dickens et al. | 52/454 |
| 4,284,447 | 8/1981 | Dickens et al. | 156/78 |
| 4,301,632 | 11/1981 | Wagner | 52/211 |
| 4,601,138 | 7/1986 | Hampton | 52/86 |
| 4,642,955 | 2/1987 | Webb | 52/204 |
| 4,665,666 | 5/1987 | Hampton | 52/86 |
| 4,780,998 | 11/1988 | Knapp | 52/211 |
| 4,785,605 | 11/1988 | Jenn | 52/745 |
| 4,873,796 | 10/1989 | Akmese | 52/81.4 |
| 4,955,168 | 9/1990 | Barry | 52/210 |
| 5,067,288 | 11/1991 | Takahama et al. | 52/81.2 |
| 5,130,915 | 7/1992 | Lerch | 52/81.2 X |
| 5,341,610 | 8/1994 | Moss | 52/80.1 X |
| 5,459,974 | 10/1995 | Barry et al. | 52/745.08 |

FOREIGN PATENT DOCUMENTS

| | | | |
|---|---|---|---|
| 533433 | 12/1954 | Belgium | 52/80.1 |
| 1489329 | 4/1967 | France | 356/52 |
| 535641 | 11/1955 | Italy . | |
| 20684 | 9/1906 | United Kingdom | 52/86 |
| 540881 | 11/1941 | United Kingdom . | |
| 1059397 | 6/1964 | United Kingdom . | |

*Primary Examiner*—Carl D. Friedman
*Assistant Examiner*—Beth Aubrey
*Attorney, Agent, or Firm*—Stetina Brunda & Buyan

[57] ABSTRACT

A domed ceiling structure for attachment to an elevated support. The ceiling structure comprises a peripheral frame member which is attachable to the support frame, and a plurality of arcuate support members, each of which has first and second ends, an upper surface, and an under surface. The first ends of the support members are attached to the frame member in a manner wherein the second ends extend to a common area and the under surfaces collectively define a dome shaped support surface to which a layer of finishing material may be applied.

2 Claims, 3 Drawing Sheets

Fig. 1
(PRIOR ART)
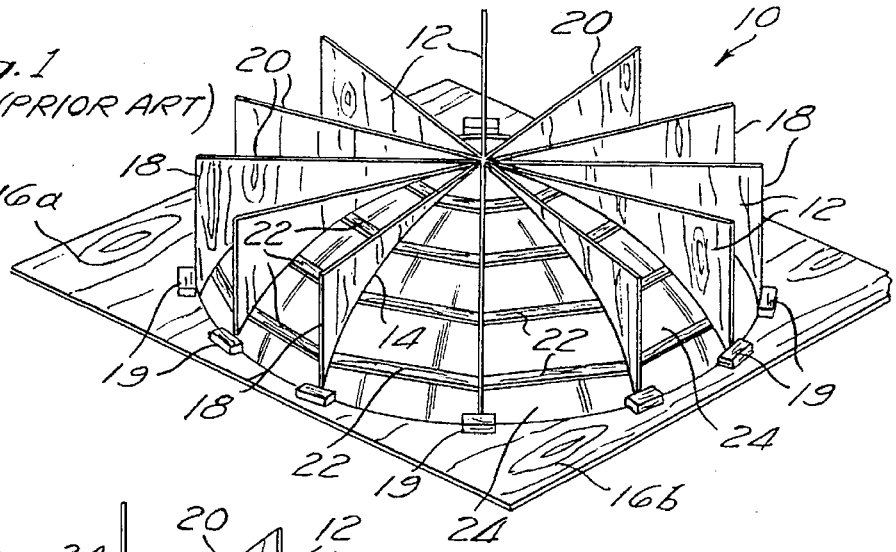
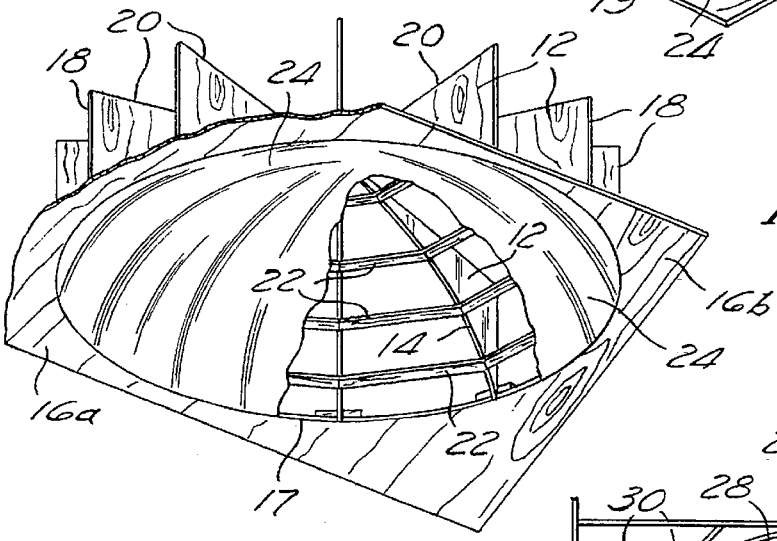
Fig. 2
(PRIOR ART)
Fig. 3
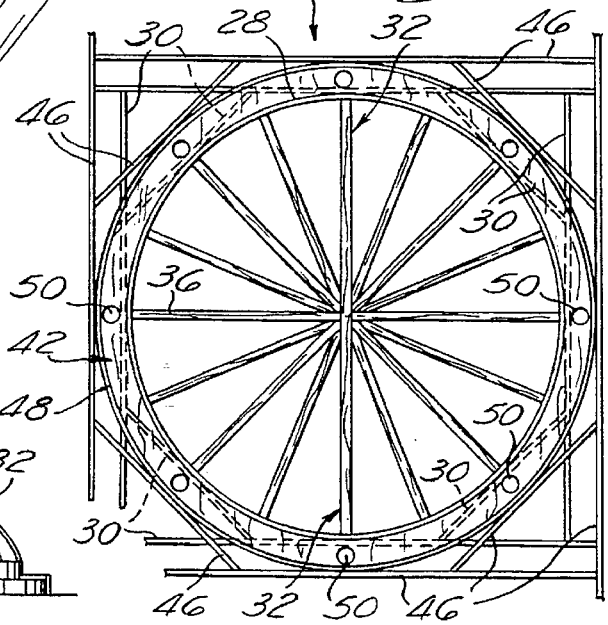
Fig. 4
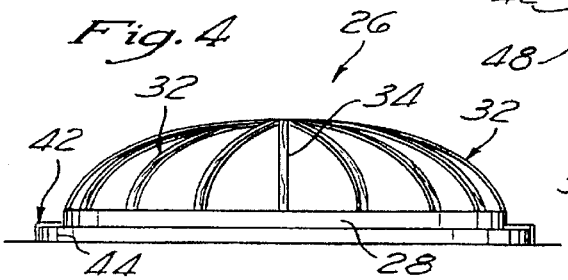

Fig. 5
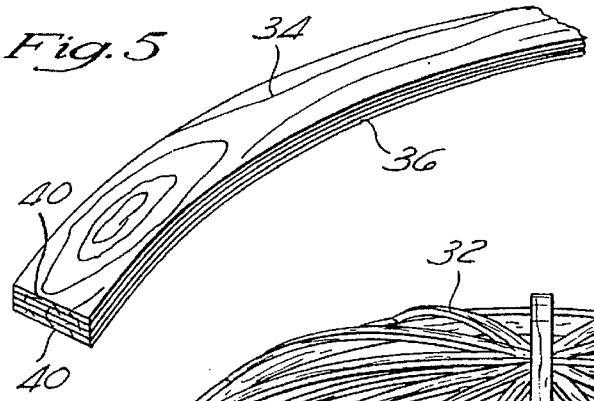
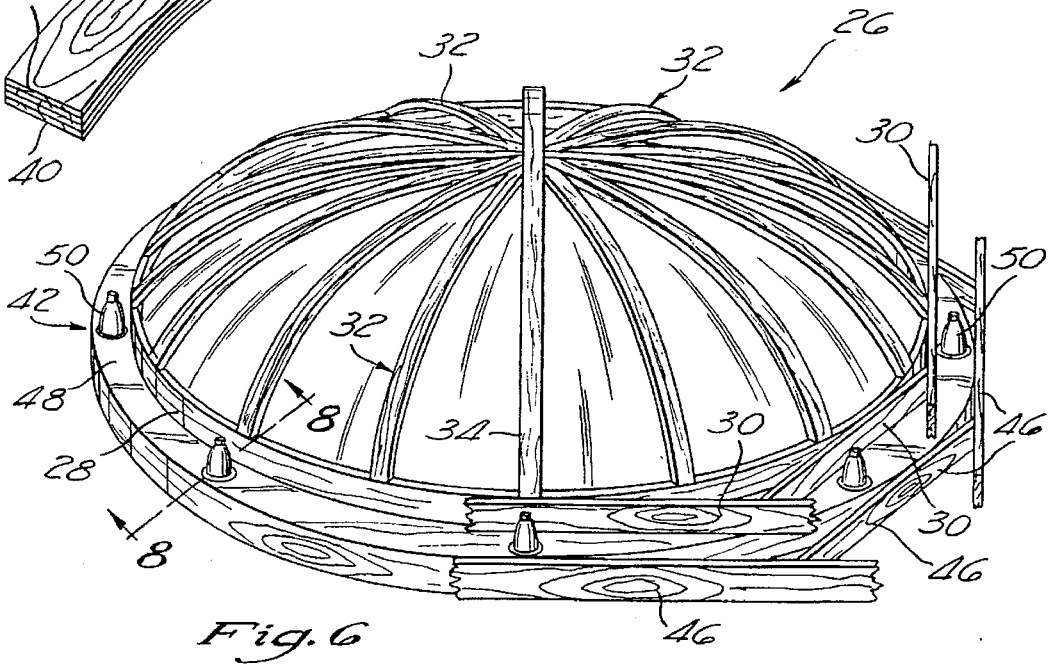
Fig. 6
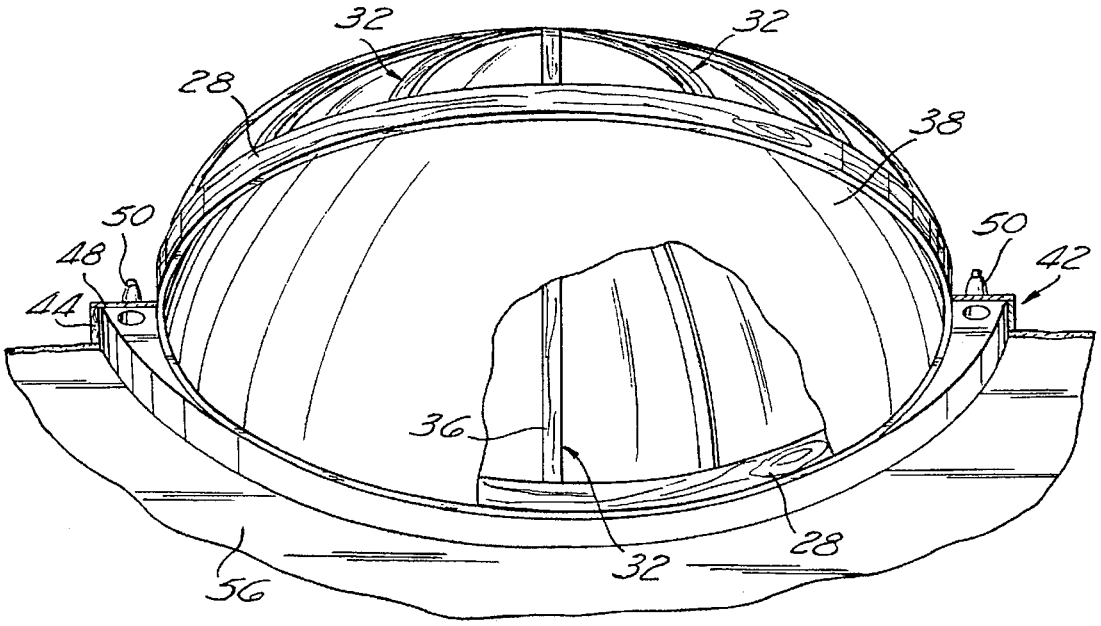
Fig. 7

26
32
38
34
28
42
50
48
21
44
52
54
56

DOMED CEILING STRUCTURE

FIELD OF THE INVENTION

The present invention relates generally to the art of building construction, and more particularly to a domed ceiling structure and method of installing the same into an elevated support structure. The present invention is particularly applicable to new building construction and will be described herein with particular reference thereto, although it will be appreciated that the invention has broader applications and will also find utility as a retrofit item to be used in renovating or remodeling existing structures.

BACKGROUND OF THE INVENTION

The installation of dome shaped ceilings in foyers or other rooms of a residential or commercial structure has heretofore required considerable skill and labor. In the prior art, the method of installing a domed ceiling structure typically begins by cutting multiple pieces of plywood to form arcuately contoured cut-outs therewithin. Thereafter, one end of each of the plywood pieces is nailed to the peripheral edge of a circular cut-out formed within one or more plywood sheets. The ends of the plywood pieces are nailed to the peripheral edge in equidistantly spaced relation to each other, with the opposite ends thereof extending to a common point and the arcuately contoured cut-outs being substantially aligned with each other. The ends of the plywood pieces which extend to the common point are themselves affixed to each other.

Subsequent to the attachment of the plywood pieces to the peripheral edge of the cut-out, elongate wooden pieces (i.e., two-by-fours) are then extended laterally between respective pairs of the plywood pieces. The opposed ends of the two-by-fours are positioned upon the cut-outs formed in the plywood pieces so as to roughly approximate a dome shaped pattern, and are subsequently nailed to respective ones of the plywood pieces. As will be recognized, the two-by-fours positioned between each pair of plywood pieces are of gradually decreasing length, with the two-by-four disposed closest to the peripheral edge of the circular cut-out being the greatest in length and the two-by-four disposed furthest from the peripheral edge being the shortest in length. Subsequent to the placement of the two-by-fours between the plywood pieces, the plywood sheet(s) is lifted within and attached to a support structure such as ceiling joists. Thereafter, a sheet of drywall or other ceiling material is applied to the downwardly facing sides of the two-by-fours and nailed thereto, thus forming the dome shaped ceiling structure.

The above-described prior art method of installing a dome shaped ceiling structure is known to be time consuming and expensive, and to result in non-uniform and oftentimes uneven interior ceiling surfaces. Because such defects are usually readily visible, the builder is often called upon to undertake remedial work after the ceiling and interior walls have been finished and painted. The lack of uniformity of the ceiling surface is often attributable to the fact that the drywall or other ceiling material is affixed only to the two-by-fours, rather than to the arcuately contoured cut-outs formed within the plywood pieces. There is also known in the prior art pre-cast, dome shaped ceiling structures which are molded from plaster or fiberglass. Though these pre-cast domed ceiling structures present a uniform ceiling surface, they are deficient in that they are typically available only in certain predetermined sizes, and thus do not accommodate particular size/dimensional requirements or construction methodologies.

Thus, there exists a need in the art for a simple, inexpensive and uniformly shaped domed ceiling structure which is attachable to an elevated support structure, such as ceiling joists and creates a smoothly curved and uniform ceiling structure. In view of the deficiencies of the prior art, the present invention is intended to provide a desired inexpensive and simple domed ceiling structure which may be reproducibly manufactured in a range of sizes to accommodate various foyer and room sizes, and differing construction methodologies.

SUMMARY OF THE INVENTION

In accordance with the present invention, there is provided a domed ceiling structure for attachment to an elevated support frame or structure, such as ceiling joists. The ceiling structure comprises a peripheral frame member which is attachable to the support structure, and a plurality of support members, each of which includes first and second ends, an upper surface and an under surface. The first ends of the support members are attached to the frame member in a manner wherein the second ends extend to a common area and the under surfaces collectively define a dome shaped support surface to which a sheet or layer of finishing material such as drywall may be applied. When the first ends of the support members are attached to the frame member, the under surfaces thereof are in substantial alignment with each other. In the preferred embodiment, the frame member itself comprises a plurality of arcuate frame segments which extend in end-to-end fashion.

Each of the support members preferably comprises a laminate structure consisting of individual thin wood members formed around an arcuate jig and bonded in juxtaposition to one another so as to provide a unitary laminated structure of predetermined length and thickness. Similarly, thin strips of wood, paper, textile or other materials may be placed upon a suitable jig with appropriate bonding agents being applied to provide a generally rigid, laminated support member. Each support member may also be formed of bonded particles or fibrous materials. The particulate or fibrous material, along with any binding agents or other ingredients, may be poured or injected into an arcuate mold. Under sufficient temperature, pressure, and other conditions, the desired arcuate structure will thus be formed within the mold. Moreover, each support member may be formed from a molded plastic material. The arcuate support members may be specifically sized to form a domed ceiling structure within a desired area of the residential or commercial structure and/or to accommodate a specific type of ceiling construction.

Further in accordance with the present invention, there is provided a domed ceiling structure comprising inner and outer frame members which are attachable to the elevated support structure and include top and bottom edges. The outer frame member is larger than the inner frame member, and is spaced outwardly relative thereto. Attached to and extending between the bottom edge of the inner frame member and the top edge of the outer frame member is a support panel which includes a plurality of light fixtures disposed therewithin. The first ends of a plurality of arcuate support members are attached to the top edge of the inner frame member in a manner wherein the second ends thereof extend to a common area. The under surfaces of the support members collectively define a dome shaped support surface to which a sheet or layer of finishing material such as drywall may be applied. Both the inner and outer frame members comprise a plurality of arcuate frame segments which extend in end-to-end fashion.

Further in accordance with the present invention, there is provided a method of installing a domed ceiling structure into an elevated support structure. The method comprises the step of providing a plurality of arcuate support members, each of which includes first and second ends, an upper surface and an under surface. The first ends of the support members are attached to a peripheral frame member in a manner wherein the second ends extend to a common area and the under surfaces collectively define a dome shaped support surface. Thereafter, the frame member is attached to the elevated support structure, with a sheet or layer of finishing material such as drywall then being applied to the dome shaped support surface.

BRIEF DESCRIPTION OF THE DRAWINGS

These, as well as other features of the present invention, will become more apparent upon reference to the drawings wherein:

FIG. 1 is a top perspective view of a prior art domed ceiling structure;

FIG. 2 is a bottom perspective view of the prior art domed ceiling structure;

FIG. 3 is a bottom plan view of a domed ceiling structure constructed in accordance with the present invention;

FIG. 4 a side-elevational view of the domed ceiling structure of the present invention;

FIG. 5 is a partial perspective view of an arcuate support member included in the domed ceiling structure of the present invention;

FIG. 6 is a top perspective view of the domed ceiling structure of the present invention;

FIG. 7 is a bottom perspective view of the domed ceiling structure of the present invention.

DETAILED DESCRIPTION OF THE PREFERRED EMBODIMENT

Figure 8:
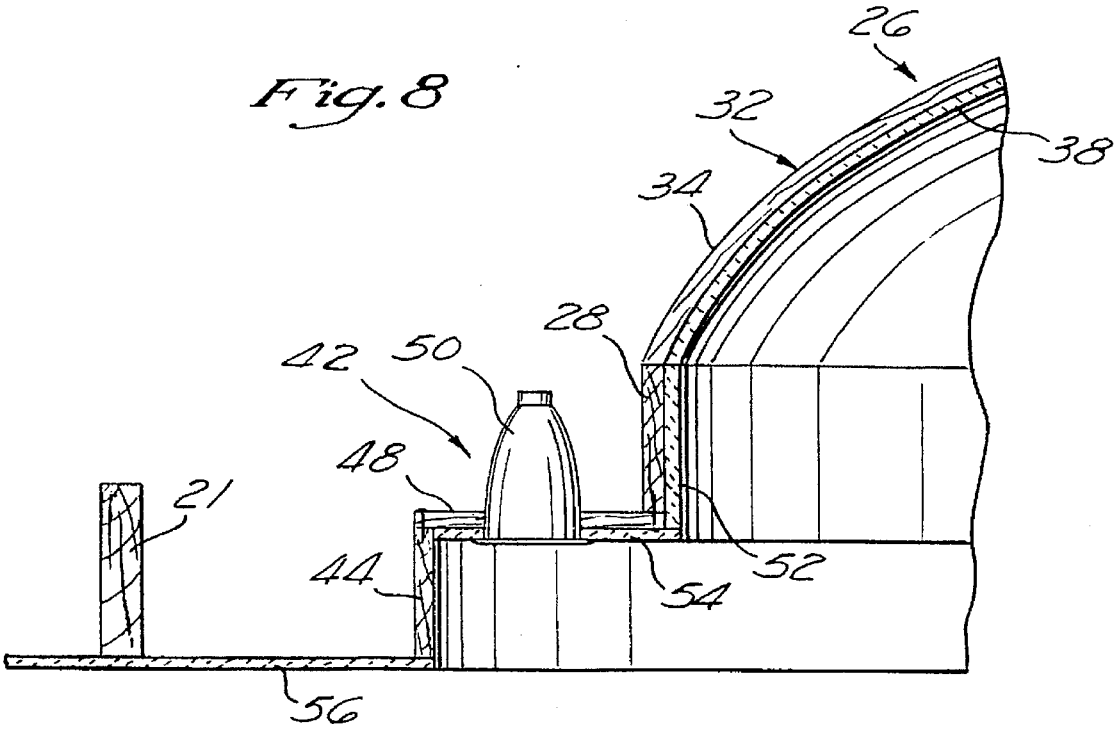
FIG. 8 is a cross-sectional view taken along line 8—8 of FIG. 6.

Referring now to the drawings wherein the showings are for purposes of illustrating a preferred embodiment of the present invention only, and not for purposes of limiting the same, FIGS. 1 and 2 perspectively illustrate a domed ceiling structure 10 assembled in accordance with a prior art construction methodology.

The prior art ceiling structure 10 is fabricated by initially cutting multiple pieces of plywood 12 to form arcuately contoured cut-outs 14 therewithin. The plywood pieces 12 are positioned within a circularly configured cut-out formed within a pair of plywood sheets 16*a*, 16*b* which extend in co-planar relation to each other. In particular, the lower ends of the vertical edges 18 of the plywood pieces 12 are attached to the peripheral edge 17 of the cut-out and to respective ones of the support blocks 19 attached to the plywood sheets 16*a*, 16*b*. The inner ends of the horizontal edges 20 of the plywood pieces 12 extend to a common point and are affixed to each other. The vertical edges 18 are separated from each other by equidistantly spaced intervals when the plywood pieces 12 are attached to the peripheral edge 17. Additionally, the arcuate cut-outs 14 of the plywood pieces 12 extend in substantial alignment with each other. The plywood sheets 16*a*, 16*b* are typically secured to ceiling joists or another support structure prior to the attachment of the plywood pieces 12 thereto in the previously described pattern.

Subsequent to the attachment of the plywood pieces 12 to the peripheral edge 17 in the aforementioned manner, elongate wooden pieces 22 (i.e., two-by-fours) are extended between respective pairs of the plywood pieces 12. As best seen in FIG. 2, the opposed ends of the wooden pieces 22 are positioned upon the cut-outs 14 of the plywood pieces 12 so as to roughly approximate a dome shaped pattern, and are subsequently nailed thereto. Due to the manner in which the plywood pieces 12 are arranged within the circular cut-out and secured to the peripheral edge 17, the wooden pieces 22 are of gradually decreasing length, with those disposed closest to the edge 17 being of greatest length and those disposed furthest from the edge 17 being of the shortest length. After the wooden pieces 22 have been extended between and attached to the plywood pieces 12, a layer of drywall 24 or other ceiling material is nailed to the downwardly facing sides of the wooden pieces 22, thus forming the domed ceiling structure 10.

As previously explained, the above-described prior art method of installing a domed ceiling structure is known to be time consuming and expensive, and to result in non-uniform and oftentimes uneven interior ceiling surfaces. In this respect, since the sheet or layer of drywall 24 is attached to the wooden pieces 22 which roughly approximate a domed pattern rather than directly to the cut-outs 14 of the plywood pieces 12, the drywall 24 seldom assumes a uniform dome shape which is readily visible and typically necessitates remedial work to cure such defect. As also previously indicated, the pre-cast dome shaped ceiling structures which are molded from plaster or fiberglass are typically available only in certain predetermined sizes, and do not accommodate particular size/dimensional requirements or construction methodologies.

Referring now to FIGS. 3, 4, 6, and 7, there is depicted a domed ceiling structure 26 constructed in accordance with the present invention which is adapted to be attached to an elevated support frame or structure. Typically, such elevated support frame or structure comprises a plurality of ceiling joists, the frame members of a soffit, or the headers extending along the top ends of wall studs.

In the preferred embodiment, the ceiling structure 26 comprises an inner frame member 28 which has a generally circular configuration. The inner frame member 28 is preferably formed from a plurality of arcuate inner frame segments which extend in end-to-end fashion. As best seen in FIGS. 3 and 6, in assembling the ceiling structure 26, the inner frame segments are typically secured to respective ones of the support members 30 of an inner support frame. The inner support frame has a generally square configuration, with support members 30 extending diagonally across each of the four (4) corner regions thereof. Due to the manner in which the support members 30 are arranged within the inner support frame, the circular inner frame member 28 (and in particular each of the inner frame segments comprising the same) comes into abutting contact with portions of the inwardly facing surfaces of each of the support members 30. The support members 30 of the inner support frame are each preferably fabricated from elongate pieces of wood.

Referring now to FIGS. 3–7, the domed ceiling structure 26 of the present invention further comprises a plurality of arcuate support members 32, each of which includes first and second ends, an upper surface 34, and an under surface 36. In the ceiling structure 26, the first ends of the support members 32 are attached to the top edge of the inner frame member 26 in a manner wherein the second ends extend to a common area and the under surfaces 36 collectively define a dome shaped support surface to which a sheet or layer 38 of finishing material such as drywall may be applied, as seen in FIG. 7. When attached to the top edge of the inner frame member 28, the first ends of the support members 32 are separated from each other by equidistantly spaced intervals. Additionally, the under surfaces 36 of the support members 32 are in substantial alignment with each other, with the common area to which the second ends extend defining the crest or apex of the dome shaped support surface to which the layer 38 of finishing material is applied. It will be recognized that the first ends of the support members 32 may alternatively be attached to the outer surface of the inner frame member 26 rather than to the top edge thereof.

The attachment of the first ends of the support members 32 to the top edge of the inner frame member 28 is preferably facilitated through the use of nails. As an alternative to nails, it will be recognized that the first ends of the support members 32 may be attached to the top edge of the inner frame member 28 by other connecting devices such as brads, corrugated connectors, or any other apparatus capable of joining wood members. Additionally adhesives may be utilized as an alternative to nails or other types of fasteners.

As seen in FIGS. 3 and 6, only four (4) of the support members 32 have second ends which are substantially straight. These particular support members 32 are separated from each other by intervals of approximately 90 degrees, with the second ends of one opposed pair extending to the axis of the inner frame member 28 and being abutted against each other. The second ends of the remaining support members 32 are not substantially straight, but rather are cut or formed to define a point which facilitates the placement thereof between those support members 32 having the straight second ends. In the preferred embodiment, the second ends of each of the support members 32 are affixed to each other. Though not shown, such affixation is typically accomplished by placing a piece of plywood upon the upper surfaces 34 of the support members 32 at the common area where the second ends thereof meet, and subsequently attaching such plywood piece to each of the support members 32.

In the ceiling structure 26, the support members 32 may be fabricated in any one of a variety of different lengths and contours, depending upon the desired diameter and height of the domed support surface to which the layer 38 of finishing material is to be applied. Additionally, though the inner frame member 28 will typically have a circular configuration, it will be recognized that the same may alternatively be provided in an oval or elliptical configuration, with the support members 30 used in conjunction therewith being specifically sized and shaped to define the corresponding dome shaped support surface. As will be recognized, the sheet or layer 38 of drywall or other finishing material is typically cut into wedge-shaped sections prior to being applied to the dome shaped support surface defined by the under surfaces 36 of the support members 32.

As best seen in FIG. 5, each of the support members 32 is preferably formed by the laminar disposition of multiple wood laminate layers 40 which are fused together to form a unitary, laminated structure. The individual laminate layers 40 are typically formed around an arcuate jig structure with glue or another binding agent being interfacially deposited between the individual laminate layers 40 so as to result in a rigid, laminated structure having the desired arcuate shape. Alternatively, each support member 32 may be formed from bonded particulate matter including cellulose fiber, shredded paper, wooden particles, sawdust, and possible combinations thereof. A quantity of these wooden or paper particles are typically placed into an arcuate mold along with various binding agents or other chemicals capable of resulting in a composite structure of sufficient integrity to serve the desired functions of the present invention. Each support member 32 may also be formed from strips of various wooden, paper, textile, or other materials which are applied along with appropriate bonding agents to an arcuate jig to form a laminated structure. Further, each support member 32 may also be formed from a molded plastic material.

Subsequent to the formation of the support members 32 by any one of the aforementioned procedures, the second ends of at least some of the support members 32 must be cut in the previously described manner so as to be placeable within the ceiling structure 26. However, rather than being subsequently cut, such support members 32 may alternatively be formed to include specifically shaped pointed second ends. The inner and outer frame members 28, 44 are preferably fabricated in the same manner as the support members 32.

The ceiling structure 26 is preferably installed by initially assembling the inner support frame, and thereafter attaching the inner frame segments thereto in an end-to-end fashion so as to define the circular inner frame member 28. Thereafter, the support members 32 are attached to the inner frame member 28 in the aforementioned manner so as to define the dome shaped support surface. The inner support frame is then hoisted into a desired location, and secured to the elevated support structure (i.e., the ceiling joists, frame members of the soffit, headers of the wall studs, etc.). After the inner support frame has been secured in place, the wedge shaped pieces of drywall or other finishing material are applied to the dome shaped support surface defined by the under surfaces 36 of the support members 32 so as to form the layer 38 of ceiling material. The layer 38 may then be finished and painted in accordance with conventional building techniques.

Advantageously, in the ceiling structure 26 of the present invention, the layer 38 of drywall or other finishing material is applied and attached directly to the under surfaces 36 of the support members 32. As a result, the layer 38 assumes a smooth, uniform contour due to the continuous arcuate transition between the first and second ends of the support members 32 defined by the under surfaces 36 thereof. Thus, subsequent to the attachment of the layer 38 to the support members 32, remedial finishing measures for correcting visually apparent unevenness in the dome shaped surface of the ceiling structure 26 is rarely required.

Referring now to FIGS. 3–8, the domed ceiling structure 26 of the present invention may further be provided with an annular lighting ring 42 which extends about the periphery of the inner frame member 28. The lighting ring 42 comprises a circularly configured outer frame member 44 which has a diameter exceeding that of the inner frame member 28. The outer frame member 44 is preferably formed from a plurality of arcuate outer frame segments which extend in end-to-end fashion. The outer frame segments are themselves attached to respective ones of the support members 46 of an outer support frame. Like the inner support frame, the outer support frame has a generally square configuration, with four (4) of the support members 46 extending diagonally across the corner regions thereof. Due to the manner in which the support members 46 are assembled in the outer support frame, the circular outer frame member 44 (and in particular each of the outer frame segments comprising the same) is abutted against portions of the inwardly facing surfaces of the support members 46, as best seen in FIG. 3. The support members 46, like the support members 30 of the inner support frame, each preferably comprise elongate pieces of wood. As will be recognized, the outer support frame is configured identically to, but larger than, the inner support frame. Additionally, when the lighting ring 42 is included in the ceiling structure 26, the inner and outer support frames are preferably attached to each other.

As best seen in FIGS. 7 and 8, attached to and extending between the top edge of the outer frame member 44 and bottom edge of the inner frame member 28 is an annular support panel 48. In the preferred embodiment, the support panel 48 is sized and configured such that when nailed to the top edge of the outer frame member 44 and bottom edge of the inner frame member 28, the outer peripheral edge thereof is substantially flush with the outer surface of the outer frame member 44, with the inner peripheral edge thereof being substantially flush with the inner surface of the inner frame member 28. Disposed within the support panel 48 and spaced equidistantly about the periphery thereof are a plurality of light fixtures 50.

When the lighting ring 42 is included in the ceiling structure 26, the inner and outer support frames are assembled in the aforementioned manner, with the inner and outer frame members 28, 44 being attached thereto. Thereafter, the inner frame member 28 is coaxially aligned with the outer frame member 44, with the support panel 48 then being extended between and attached to the inner and outer frame members 28, 44 in the previously described manner, and the inner and outer support frames being attached to each other as well. As previously indicated, since the diameter of the outer frame member 44 exceeds that of the inner frame member 28, an annular gap of uniform width is defined therebetween when the inner frame member 28 is coaxially aligned with the outer frame member 44.

Subsequent to the attachment of the inner and outer support frames to each other, the support members 32 are attached to the top edge of the inner frame member 28 in the previously described manner, with the light fixtures 50 being positioned about and secured to the support panel 48. The inner and outer support frame are then hoisted into and attached to the elevated support structure (e.g., ceiling joists 21 as shown in FIG. 8). As previously indicated, the elevated support structure may also comprise the frame members of a soffit as well as the headers extending along the top ends of wall studs. After the inner and outer support frames have been attached to the elevated support structure, the layer 38 of drywall or other finishing material is attached to the under surfaces 36 of the support members 32 in the previously described manner. Additionally, as seen in FIG. 8, a layer 52 of finishing material is also typically applied to the inner surface of the inner frame member 28, with a layer 54 of finishing material being applied to the bottom surface of the support panel 48. Though not shown, a layer of finishing material may also be applied to the inner surface of the outer frame member 44. The ceiling 56 itself is typically attached to the bottom edge of the outer frame member 44 and substantially flush with the inner surface thereof. As will be recognized, in the event the lighting ring 42 is not included in the ceiling structure 26, the ceiling 56 will be attached to the bottom edge of the inner frame member 28 and substantially flush with the inner surface thereof.

Irrespective of whether the lighting ring 42 is included in the ceiling structure 26, the layer 52 of finishing material will typically be applied to the inner surface of the inner frame member 28. Though the ceiling structure 26 (with or without the lighting ring 42) is typically attached to the elevated support structure through the utilization of the inner support frame (and outer support frame if the lighting ring 42 is included), it will be recognized that the inner frame member 28 alone or in combination with the outer frame member 44 may be secured directly to the elevated support structure, and that the inner and outer support frames need not be included in the ceiling structure 26. Additionally, when the ceiling structure 26 is installed into the elevated support structure of a multi-story building, the support members 32 may be sized such that the second ends thereof are attachable to and therefore supported by the floor joists of the next level.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A domed ceiling structure for attachment to an elevated support frame, said ceiling structure comprising:

an inner frame member attachable to the support frame and including top and bottom edges;

an outer frame member attachable to the support frame and including top and bottom edges, said outer frame member being spaced outwardly relatively to the inner frame member;

a support panel attached to and extending between the bottom edge of the inner frame member and the top edge of the outer frame member;

a plurality of light fixtures disposed within said support panel; and a plurality of arcuate support members, each of said support members having first and second ends, an upper surface, and an under surface;

the first ends of the support members being attached to the top edge of the inner frame member in a manner wherein the second ends extend to a common area and the under surfaces collectively define a dome shaped support surface to which a layer of finishing material may be applied.

2. The ceiling structure of claim 1 wherein the inner and outer frame members each comprise a plurality of arcuate frame segments which extend in end-to-end fashion.

* * * * *